United States Patent [19]

Dienes

[11] Patent Number: 4,851,857

[45] Date of Patent: Jul. 25, 1989

[54] HIGH-POWER, END-FED, NON-COAXIAL UHF-TV BROADCAST ANTENNA

[75] Inventor: Geza Dienes, Claremont, Calif.

[73] Assignee: Andrew Corporation, Orland Park, Ill.

[21] Appl. No.: 178,246

[22] Filed: Apr. 6, 1988

[51] Int. Cl.[4] ..... H01Q 13/12

[52] U.S. Cl. ..... 343/771; 343/890; 333/251

[58] Field of Search ..... 343/768, 770, 771, 890, 343/891; 333/21 R, 21 A, 242, 251

[56] References Cited

U.S. PATENT DOCUMENTS

| | | | |
|---|---|---|---|
| 2,603,709 | 7/1952 | Bowen | 333/21 A |
| 2,679,590 | 5/1954 | Riblet | 343/771 |
| 2,712,604 | 7/1955 | Thomas et al. | 343/771 |
| 2,971,193 | 2/1961 | Siukola | 343/770 |
| 4,197,549 | 4/1980 | Collins | 343/771 |
| 4,549,310 | 10/1985 | Woodward | 343/890 |
| 4,583,098 | 4/1986 | Sikina | 343/771 |
| 4,590,479 | 5/1986 | Ben-Dov | 343/771 |

*Primary Examiner*—Rolf Hille
*Assistant Examiner*—Michael C. Wimer
*Attorney, Agent, or Firm*—Stephen G. Rudisill

[57] ABSTRACT

A high-power, end-fed, circular, non-coaxial waveguide UHF-TV broadcast antenna comprising a single-moded, circular, non-coaxial waveguide having an inside diameter dimensioned to support only the circular non-coaxial $TE_{11}$ mode of energy propagation through the waveguide at the design frequency of the operating frequency band, the waveguide having multiple radiating elements removing energy from the waveguide at intervals along the length of the waveguide, and conductive means extending transversely across the interior of the waveguide at least in the regions between longitudinally adjacent pairs of the radiating elements, the conductive means being perpendicular to the electric field vector of the $TE_{11}$-mode energy having a desired polarization, for suppressing $TE_{11}$-mode energy that is cross-polarized relative to the desired polarization, the waveguide and the conductive means defining a feed port at one end of the waveguide for receiving UHF-TV signals having the desired polarization.

11 Claims, 2 Drawing Sheets

HIGH-POWER, END-FED, NON-COAXIAL UHF-TV BROADCAST ANTENNA

FIELD OF THE INVENTION

The present invention relates generally to high-power, end-fed, non-coaxial waveguide UHF-TV broadcast antennas and, more particularly, to such antennas which are single-moded.

SUMMARY OF THE INVENTION

It is a primary object of the present invention to provide an improved high-power, end-fed, non-coaxial, single-moded waveguide UHF-TV broadcast antenna which offers the combination of a large power-handling capability, a simple design which can be easily and efficiently manufactured, and a high degree of stiffness so that it can withstand large wind loads without excessive deformation and degradation of electrical performance.

It is another important object of this invention to provide such an improved high-power, end-fed, non-coaxial waveguide antenna which provides the antenna engineer or designer with more than the usual number of degrees of freedom to control the VSWR and the horizontal and vertical radiation patterns of the antenna.

A further object of the invention is to provide such an improved antenna which maintains a prescribed polarization of the electromagnetic energy as it is propagated along the entire length of the interior of the antenna.

Yet another object of the invention to provide an antenna of the foregoing type which is substantially free from moding problems, including both cross-polarized and higher-order modes.

In accordance with the present invention, the foregoing objectives are realized by providing a high-power, end-fed, non-coaxial waveguide UHF-TV broadcast antenna comprising a single-moded, non-coaxial waveguide having an inside diameter dimensioned to support only the circular non-coaxial $TE_{11}$ mode or the square $TE_{10}$ mode of energy propagation through the waveguide at the design frequency of the operating frequency band, the waveguide having multiple radiating elements removing energy from the waveguide at intervals along the length of the waveguide; and conductive means extending transversely across the interior of the waveguide at least in the regions between longitudinally adjacent pairs of the radiating elements, the conductive means being perpendicular to the electric field vector of the circular $TE_{11}$-mode or square $TE_{10}$-mode or the diagonal $TE_{10}$-mode energy having a desired polarization, for suppressing unwanted energy that is cross-polarized relative to the desired polarization in those modes, the waveguide and the conductive means defining a feed port at one end of the waveguide for receiving UHF-TV signals having the desired polarization.

BRIEF DESCRIPTION OF THE DRAWINGS

Other objects and advantages of the invention will become apparent upon reading the following detailed description and upon reference to the drawings in which.

Figure 1:
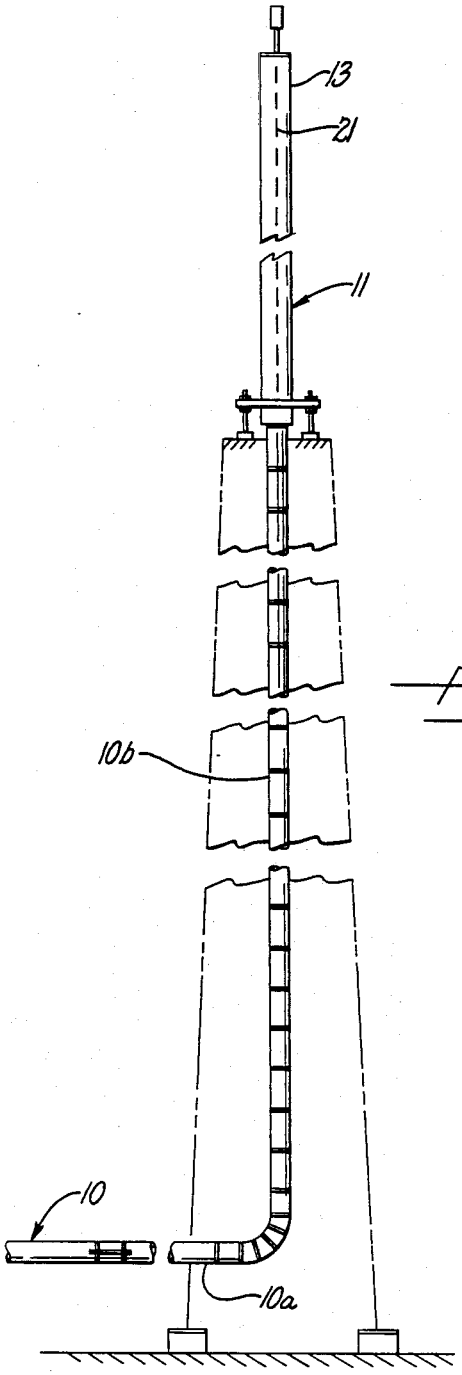
FIG. 1 is a side elevation of a television broadcast system which includes an antenna embodying the present invention.
Figure 2A:
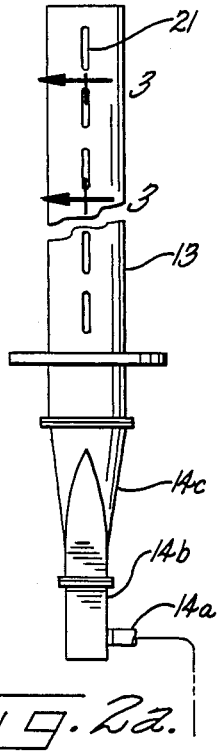
FIGS. 2*a*, 2*b*, 2*c* and 2*d* are fragmentary side elevations of four different arrangements for launching electromagnetic energy having a prescribed polarization into the lower end of the antenna in the system of FIG. 1.
Figure 2B:
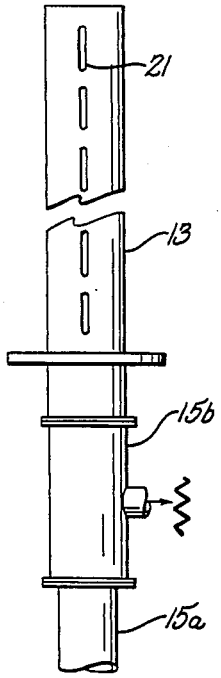
Figure 2C:
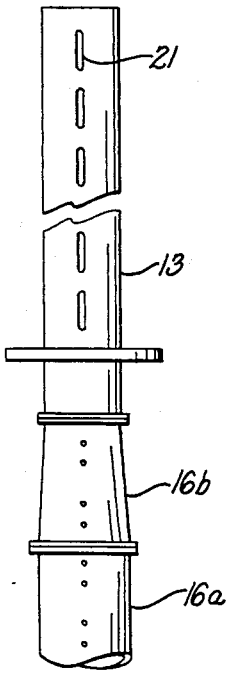
Figure 2D:
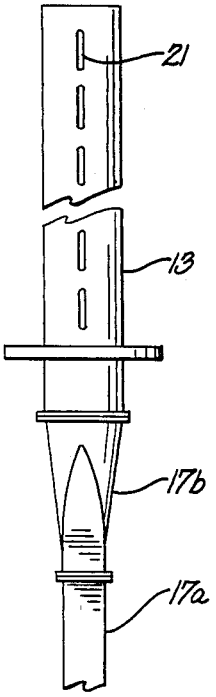

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Turning now to the drawings and referring first to FIG. 1, there is shown a UHF-TV television broadcast system having a waveguide or coaxial-cable transmission line 10 for supplying signals to an antenna 11 which is typically mounted on the top of a supporting structure such as a tower or tall building. The transmission line 10 includes a horizontal run 10*a* leading to the supporting structure and a vertical run 10*b* leading up to the antenna. To protect the antenna from the environment, the conductive portions may be surrounded by a cylindrical radome (not shown) attached to a series of longitudinal ribs (not shown) on the exterior surface of the conductive portion of the antenna.

The main body portion of the antenna 11 is a circular waveguide 13 (see FIGS. 3 and 4) having an inside diameter dimensioned to support the propagation of electromagnetic energy therethrough in the circular, non-coaxial $TE_{11}$ mode, but not in the circular, non-coaxial mode. That is, the radius of the inside surface of the waveguide 13 is at least as large as $\lambda/3.412$ (where $\lambda$ is the wavelength at the design frequency of the operating frequency band), which is large enough to support propagation of the $TE_{11}$ mode, but smaller than $\lambda/2.613$, so that the waveguide will not support propagation of the $TM_{01}$ mode. Thus, the waveguide 13 is single-moded.

Figure 4:
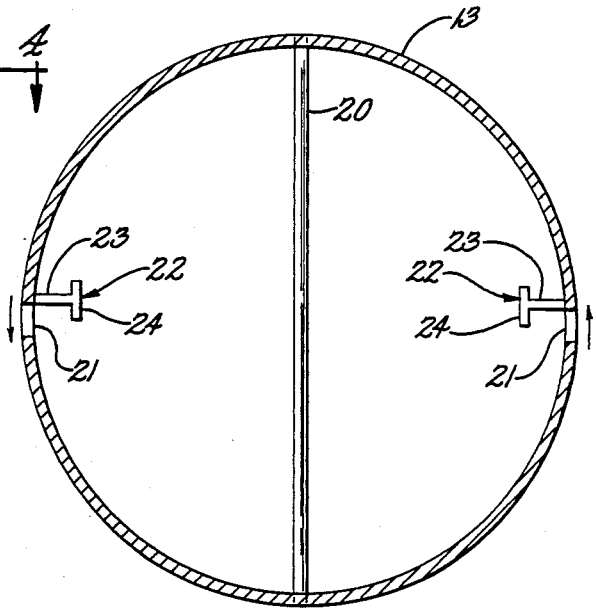
FIG. 4 is an enlarged section taken generally along line 4—4, in FIG. 3.

A diagram of the electric field vector of the $TE_{11}$ mode is shown in FIG. 4, from which it can be seen that the $TE_{11}$ mode can have different polarizations. It is desirable, however, to have only a single polarization of $TE_{11}$-mode energy in the waveguide to reliably control the radiation pattern produced by the antenna.

It will be appreciated that the circular $TE_{11}$ mode can be excited and propagated in waveguides that are not perfectly circular, such as waveguides having polygonal cross-sections, and thus the term "circular" as used herein and in the appended claims shall be understood to include such shapes.

The electromagnetic energy from the transmission line 10 must be launched into the antenna 11 with a prescribed polarization. FIGS. *2a–2d* illustrate four conventional ways to effect such launching.

In FIG. *2a*, the transmission line 10*b* is a coaxial cable 14*a* which terminates in a coaxial-to-rectangular transition 14*b*, which in turn is connected to the lower end of the antenna 11 through a rectangular-to-circular waveguide transition 14*c*. The transducer 14*a*, 14*b*, 14*c* ensures that signals from the cable are polarized in a prescribed direction before being launched into the antenna.

In FIG. *2b*, the transmission line 10*b* is an overmoded circular waveguide 15*a* which terminates at its upper end in a polarization filter 15*b* so that the polarization of the electromagnetic energy is aligned in the prescribed plane when it is launched into the lower end of the antenna waveguide 13.

In FIG. *2c*, the transmission line 10*b* is a circular waveguide 16*a* having polarization-maintaining means therein as described in co-pending U.S. patent applications Ser. No. 178,244 filed concurrently herewith, and entitled "UHF-TV BROADCAST SYSTEM HAVING CIRCULAR NON-COAXIAL WAVEGUIDE TRANSMISSION LINE FOR OPERATION IN THE $TE_{11}$ MODE". This waveguide 16*a* is overmoded to reduce attenuation losses, as a result of which the diameter is larger than that of the circular waveguide 13 which forms the main body portion of the antenna 11. Consequently, a transition 16*b* is provided between the upper end of the transmission line 10 and the antenna 11 to provide a smooth transition between the larger diameter of the transmission line and the smaller diameter of the antenna waveguide 13.

In FIG. *2d* the transmission line 10*b* is a rectangular waveguide 17*a* which is capable of maintaining the electromagnetic energy in a fixed polarization along the entire length of the transmission line. At the upper end of the rectangular waveguide 17*a*, a rectangular-to-circular waveguide transition 17*b* connects the rectangular waveguide 17*a* to the circular waveguide 13 which forms the main body portion of the antenna 11.

To suppress unwanted $TE_{11}$ mode-energy that is cross-polarized relative to the $TE_{11}$ mode-energy having the desired polarization, a multiplicity of conductive pins 20 extend diametrically across the interior of the waveguide 13. Adjacent pins 20 are usually spaced from each other by less than about a quarter wavelength at the design frequency in the operating frequency band. At uniform intervals along the length of the waveguide 13, however, adjacent pins 20 are spaced by $\frac{3}{8}$ to $\frac{5}{8}$ wavelength to provide a pin-free cavity in which a pair of radiating slots 21 are formed in the side walls of the waveguide 13.

The pins 20 are made of conductive metal and are fastened to the walls of the waveguide. For example, each pin may be inserted through a pair of diametrically opposed holes drilled in the walls of the waveguide, with the opposite ends of each pin being soldered or welded to the waveguide.

In the particular embodiment illustrated, the two radiating slots 21 in each cavity are diametrically opposed to each other, with the vertical center lines of the slots lying in a plane that is orthogonal to the plane of the pins 20. Each slot 21 is preferably a half wavelength long and about 0.05 wavelength wide.

Figure 3:
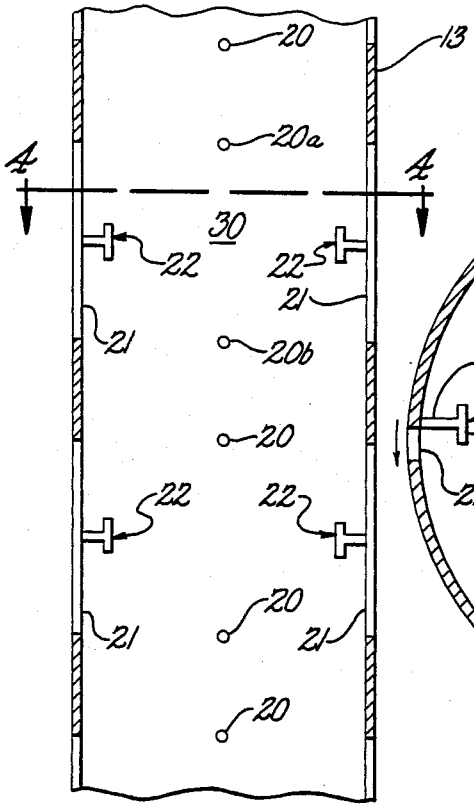
FIG. 3 is an enlarged vertical section through that portion of the internal structure of the antenna that is visible in FIG. 2.

For the purpose of coupling electromagnetic energy from the interior to the exterior of the waveguide, via the slots 21, a coupling probe 22 is mounted midway along one of the vertical edges of each slot and extends into the interior of the waveguide 13. Probes of this type are well known in the waveguide antenna art and, as can be seen in FIGS. 3 and 4, each probe 22 typically comprises a small post 23 extending radially inwardly from the edge of the slot and a small metal disk 24 mounted on the inner end of the post. Each probe 22 picks up energy from the interior of the circular waveguide 1 and feeds it to the corresponding slot 21 from which the energy is radiated with horizontal polarization.

When the slots 21 are aligned with the plane of symmetry of the $TE_{11}$ field, as they are in the illustrative embodiment (see FIG. 4), the coupling probes 22 must be offset from the vertical centerlines of the respective slots in directions that will produce in-phase radiation patterns from the opposed slots. Thus, in the design shown in FIG. 4 the right-hand probe 22 is offset in the counter-clockwise direction, while the left-hand probe 22 is offset in the clockwise direction. This causes the two slots to radiate with the polarities indicated by the arrows across the slots in FIG. 4, thereby producing individual radiation patterns that are in-phase with each other so that they have a symmetrical effect in the cumulative radiation pattern of the entire antenna.

As an alternative to the design shown in FIG. 4, the slots 21 rather than the probes 22 can be offset from the plane of symmetry of the $TE_{11}$ field. In this case, longitudinally adjacent pairs of slots are offset in opposite directions from the plane of symmetry to produce a symmetrical cumulative radiation pattern. Alternatively, the plane of the conductive pins 20 can be twisted back and forth in a serpentine path along the length of the antenna to offset the $TE_{11}$ field from the vertical centerline of a row of vertically aligned slots. This causes the plane of symmetry of the $TE_{11}$ field to be offset in opposite directions from each pair of longitudinally adjacent slots, i.e., the internal field is moved rather than the slots.

In accordance with one particular aspect of the present invention, the conductive pins are omitted in the region laterally adjacent each slot so as to form a resonant cavity in the interior of the waveguide adjacent the slot. More specifically, the cavity is resonant in the cross-polarized circular TEII mode at the design frequency of the operating frequency band. With this arrangement, each radiating element along the length of the antenna comprises the combination of a slot, the coupling probe associated with that slot, and the corresponding resonant cavity. Thus, by adjusting the properties of the cavity, e.g., by adjusting the spacing between the pins 20 on opposite sides of the cavity, the effective Q of each radiating element can be controlled to produce the desired cumulative radiation characteristics for the entire antenna. As is well-known in the art of antenna design, antenna Q can be defined as 2f times the peak energy stored by the antenna divided by the average power radiated by the antenna, where f is the design frequency. Conceptually, a high Q means that the input impedance is very sensitive to small changes in frequency.

The resonant cavities are particularly useful in designing antennas that have very little beam wobble. Beam wobble is the difference in the elevation angle of a beam between the frequencies in different portions of an operating band, such as the picture carrier and color subcarrier frequencies, or the picture carrier and the sound carrier frequencies. It is desirable to minimize the beam wobble in TV broadcast antennas, and the resonant cavities provided by this invention enable the beam wobble to be reduced by about 50% (compared with the same antenna without the resonant cavities) by providing the optimum Q for each of the multiple radiating elements along the length of the antenna.

In the particular design illustrated in FIG. 3, longitudinally adjacent pins 20 are spaced apart by a quarter wavelength except in the regions laterally adjacent the slots 21, where the spacing is increased to a half wavelength. Thus, in the region 30 laterally adjacent the upper pair of slots 21 in FIG. 3, pins 20*a* and 20*b* are spaced apart by a half wavelength. The region 30 is thus free of transverse pins and forms a resonant cavity which becomes a part of the radiating elements that include the upper pair of slots 21 in FIG. 3 and the corresponding coupling probes 22. The Q of the resonant cavity can be altered by adjusting the spacing between the pins 20*a* and 20*b*, although this spacing should normally remain within the range of about $\frac{3}{8}$ to about $\frac{5}{8}$ wavelength at the design frequency of the operating frequency band.

If it is desired to broadcast with circular polarization, the antenna must radiate vertically polarized waves in addition to the horizontally polarized waves radiated by the slots 21. The requisite vertically polarized waves can be radiated by vertically oriented dipoles mounted on the exterior of the waveguide 13 and coupled to the interior of the waveguide, as is well known in this art. One example of a suitable dipole arrangement is described in copending U.S. patent application Ser. No. 176,631 filed Apr. 1, 1988 for "ANTENNA FOR TRANSMITTING CIRCULARLY POLARIZED TELEVISION SIGNALS".

While the invention has been described with particular reference to the use of conductive pins to suppress the undesired cross-polarization, other transverse structures can be used in place of the pins. For example, a diametral septum could be used in place of the pins, with a somewhat greater power loss. The septum can be solid or provided with apertures of approximately a quarter wavelength dimension in the longitudinal direction.

Figure 5:
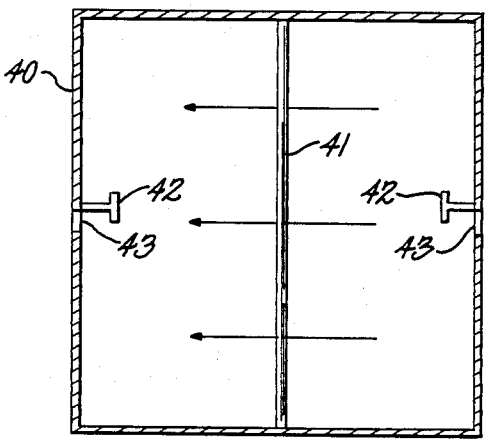
FIG. 5 is a section similar to FIG. 4 but illustrating a modified embodiment utilizing square waveguide energized in the square $TE_{10}$ mode.

FIG. 5 illustrates a modified embodiment of the antenna utilizing a waveguide 40 having a square rather than circular cross section. The counterpart of the circular $TE_{11}$ mode in a square waveguide is the $TE_{10}$ mode A diagram of the electric field vector of the square $TE_{10}$ mode is shown in FIG. 5. Pins 41 suppress the undesired cross-polarized mode, and a pair of coupling probes 42 couple energy from the interior of the waveguide 40 to a pair of radiating slots 43.

Figure 6:
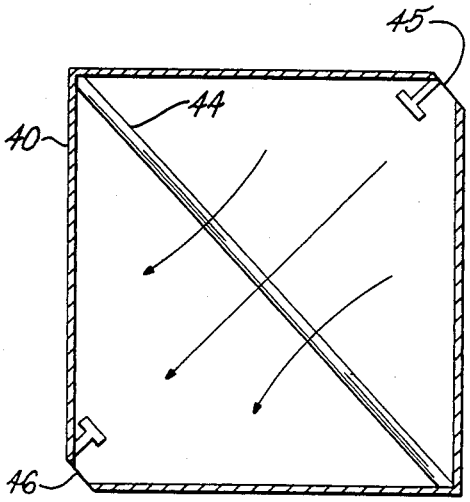
FIG. 6 is a section similar to FIG. 4 but illustrating another modified embodiment utilizing diagonal waveguide energized in the diagonal $TE_{10}$ mode.

An alternative method of operating the square waveguide is shown in FIG. 6, in which pins 44 are placed diagonally across the waveguide and slots 45 and 46 are located on the corners of the waveguide. In this configuration, the waveguide operates in the diagonal $TE_{10}$ mode which is a combination of two $TE_{10}$ modes from a square waveguide, having a field configuration as shown in FIG. 6.

Although the invention has been described with particular reference to antennas having diametrically opposed pairs of slots along the length of the antenna, it will be understood that for a generation of certain patterns it will be desirable to have only a single row of slots along one side of the antenna. With only a single slot in each bay of the antenna, the transverse pins and the resonant cavities still provide essentially the same operating advantages described above in connection with the diametrically opposed slots.

I claim:

1. A high-power, end-fed, circular, non-coaxial waveguide, UHF-TV broadcast antenna comprising a single-moded, circular, non-coaxial waveguide having a longitudinal axis and having an inside diameter dimensioned to support only the circular non-coaxial $TE_{11}$ mode of energy propagation through the wavelength at the design frequency of the operating frequency band, said wavelength having multiple radiating elements for removing energy from said waveguide, said radiating elements being positioned at longitudinal intervals along said waveguide and conductive means extending transversely across the interior of said wavelength at least in the regions between longitudinally adjacent radiating elements, said conductive means being perpendicular to the electric field vector of the $TE_{11}$-mode energy having a desired polarization, for suppressing unwanted $TE_{11}$-mode energy that is cross-polarized relative to said desired polarization, wherein said conductive means are omitted in the region laterally adjacent each of said radiating elements.

2. The antenna of claim 1 wherein said multiple radiating elements comprises slots formed in the side wall of said waveguide at intervals along the length thereof.

3. The antenna of claim 2 wherein said radiating elements comprise multiple pairs of diametrically opposed slots formed in the side wall of said waveguide at intervals along the length thereof.

4. The antenna of claim 2 which includes means for coupling electromagnetic energy from the interior of said waveguide through the respective slots to the exterior of said waveguide.

5. The antenna of claim 1 wherein said radiating elements have a vertical centerline and wherein said conductive means includes conductive pins which lie in a diametrical plane perpendicular to a plane passing through the axis of said circular waveguide and the vertical centerline of said radiating elements.

6. The antenna of claim 5 wherein adjacent conductive elements are spaced apart from each other by less than about a quarter wavelength, at the design frequency in the operating frequency band, in the regions between longitudinally adjacent radiating elements.

7. The antenna of claim 1 wherein each of said radiating elements includes a resonant cavity in the interior region of said waveguide where said conductive means are omitted, said cavity resonating in said cross-polarized $TE_{11}$ mode at said design frequency.

8. The antenna of claim 7 wherein the longitudinal dimension of said resonant cavity is between about $\frac{3}{8}$ wavelength and about $\frac{5}{8}$ wavelength at said design frequency.

9. The antenna of claim 7 wherein said resonant cavities along the length of said waveguide have Q's which reduce the beam wobble of the antenna.

10. A high-power, end-fed, square waveguide UHF-TV antenna comprising a single-moded, square waveguide having a longitudinal axis and having an inside diameter dimensioned to support only the square $TE_{10}$ mode of energy propagation through the waveguide at the design frequency of the operating frequency band, said waveguide having multiple radiating elements for removing energy from said waveguide, said radiating elements being positioned at longitudinal intervals along said waveguide, and conductive means extending transversely across the interior of said wavelength at least in the regions between longitudinally adjacent radiating elements, said conductive means being perpendicular to the electric field vector of the $TE_{10}$-mode energy having a desired polarization, for suppressing unwanted $TE_{10}$-mode energy that is cross-polarized relative to said desired polarization.

11. A UHF-TV broadcast system comprising an antenna mounted on an elevated supporting structure for broadcasting UHF-TV signals to a prescribed region, a transmission line having a horizontal run leading to the supporting structure for said antenna, and a vertical run leading to said antenna, and polarization launching means for launching electromagnetic energy into one end of said antenna with a prescribed polarization, said antenna comprising a single-moded, circular, non-coaxial waveguide having a longitudinal axis and having an inside diameter dimensioned to support only the circular non-coaxial $TE_{11}$ mode of energy propagation through the waveguide at the design frequency of the operating frequency band, said waveguide having multiple radiating elements removing energy from said waveguide, said radiating elements being positioned at longitudinal intervals along said waveguide, and conductive means extending transversely across the interior of said waveguide at least in the regions between longitudinally adjacent radiating elements, said conductive means being perpendicular to the electric field vector of the $TE_{11}$-mode energy having a desired polarization, for suppressing unwanted $TE_{11}$ mode energy that is cross-polarized relative to said desired polarization, wherein said conductive means are omitted in the region laterally adjacent each of said radiating elements.

* * * * *